US005954408A

United States Patent [19]

Bogucki

[11] Patent Number: 5,954,408

[45] Date of Patent: Sep. 21, 1999

[54] CONSOLE FOR ELECTRONIC WORK STATIONS

[75] Inventor: Peter Bogucki, Kings Park, N.Y.

[73] Assignee: Infra-Structures, Inc., Brentwood, N.Y.

[21] Appl. No.: 08/842,439

[22] Filed: Apr. 24, 1997

[51] Int. Cl.[6] ..... A47B 81/00

[52] U.S. Cl. ..... 312/223.3; 312/321; 312/132; 312/223.2; 248/419; 248/371

[58] Field of Search ..... 312/223.3, 223.2, 312/132, 133, 277, 306, 321; 108/143, 147.11, 147.17, 50.01, 50.02; 248/419, 393, 298.1, 242, 398, 371

[56] References Cited

U.S. PATENT DOCUMENTS

| | | | |
|---|---|---|---|
| 2,430,656 | 11/1947 | Wright | 248/419 |
| 3,945,599 | 3/1976 | Spier et al. | 248/298.1 X |
| 4,827,439 | 5/1989 | Licht | 312/313 X |
| 5,044,284 | 9/1991 | Gross | 248/242 X |
| 5,125,727 | 6/1992 | Lechman et al. | 312/194 |
| 5,309,686 | 5/1994 | Underwood et al. | 312/223.3 X |
| 5,483,902 | 1/1996 | Grosch | 108/143 |
| 5,522,324 | 6/1996 | Van Gelder et al. | 108/50.02 |
| 5,546,873 | 8/1996 | Conner et al. | 312/223.3 |
| 5,655,822 | 8/1997 | Roberts et al. | 312/223.3 X |
| 5,655,823 | 8/1997 | Schairbaum | 312/223.3 X |
| 5,735,222 | 4/1998 | Webb | 312/223.3 X |
| 5,762,409 | 6/1998 | Rice, Jr. | 312/223.3 X |

FOREIGN PATENT DOCUMENTS

| | | | |
|---|---|---|---|
| 526562 | 5/1931 | Germany | 108/143 |
| 3513855 | 11/1986 | Germany | 312/223.3 |
| 1003183 | 9/1965 | United Kingdom | 248/419 |
| 2252241 | 8/1992 | United Kingdom | 312/223.3 |
| 8503626 | 8/1985 | WIPO | 312/223.3 |
| 93003650 | 3/1993 | WIPO | 312/223.3 |

*Primary Examiner*—Peter M. Cuomo
*Assistant Examiner*—David E. Allred
*Attorney, Agent, or Firm*—Bauer & Schaffer, LLP

[57] ABSTRACT

A console enclosure for supporting various computer or electronic components is provided with an adjustable monitor supporting shelf within the enclosure, and adjustable keyboard table and a shielding canopy.

7 Claims, 4 Drawing Sheets

CONSOLE FOR ELECTRONIC WORK STATIONS

BACKGROUND OF THE INVENTION

The present invention relates to the construction of modular furniture assembly for electronic work stations and in particular, to a console for supporting computer equipment.

To date there have been many work station consoles manufactured, however, the majority of these systems have been intended for a singular work station or a few isolated work stations. These systems are not intended, nor suited, to be used in large scale control room settings where there may be tens of work stations ganged together in relatively small confines. Such installations are intended for virtual continuous use with one operator replacing another without the need for resetting and readjusting of the electronic components between shifts.

Those systems that have been proposed for use in larger applications tend to be complex in construction and expensive. Also, the prior art has been limited in the number of console structures and shapes that could be achieved utilizing their elemental components. The prior art has also been limited in the size and variety of computer equipment they could accommodate, as well as the ability to set up such stations for the most convenient use by several individual operators.

A particular problem found in the prior art consoles is the absence of an easy and effective way of adjusting the level of the monitor and of the keyboard to suit a variety of operators, especially when the individual consoles are to be used by more than one operator.

It is, therefore, the object of the present invention to provide a modular console structure adapted to be arranged to provide a work stations that is simple in construction and inexpensive.

It is a further object of the present invention to provide a console framework that can accommodate variously sized computer equipment and has the ability to provide adjustment on installation of the components.

These objects, as well as others, will be apparent from the following disclosure of the present invention.

SUMMARY OF THE INVENTION

In accordance with the present invention, an electronic work station is provided having a console enclosure for supporting various computer or electronic components.

The work station comprises a modular console formed with at least a front and rear structural walls, a table extending forwardly from said wall for supporting the keyboard and a shelf located between said structural walls for supporting the monitor. The shelf and the structural walls are provided with cooperating fixed bracket means attaching the shelf to the structural walls to enable the height and tilt of said monitor to be independently selected.

Preferably, the bracket means comprises a pair of plates extending inwardly from each of the front and rear walls. Each of the plates has a plurality of parallel slots interconnected by a vertical slot, while the shelf has rod stubs extending laterally from the sides thereof in paired axial alignment. The rod stubs are insertable within a selected slot in a corresponding plate and are selectively movable from slot to slot together with the table independently of each other.

BRIEF DESCRIPTION OF THE DRAWINGS

Full details of the present invention are set forth in the following description and are illustrated in the accompanying drawings.

In the Drawings

DETAILED DESCRIPTION OF THE INVENTION

Figure 1:
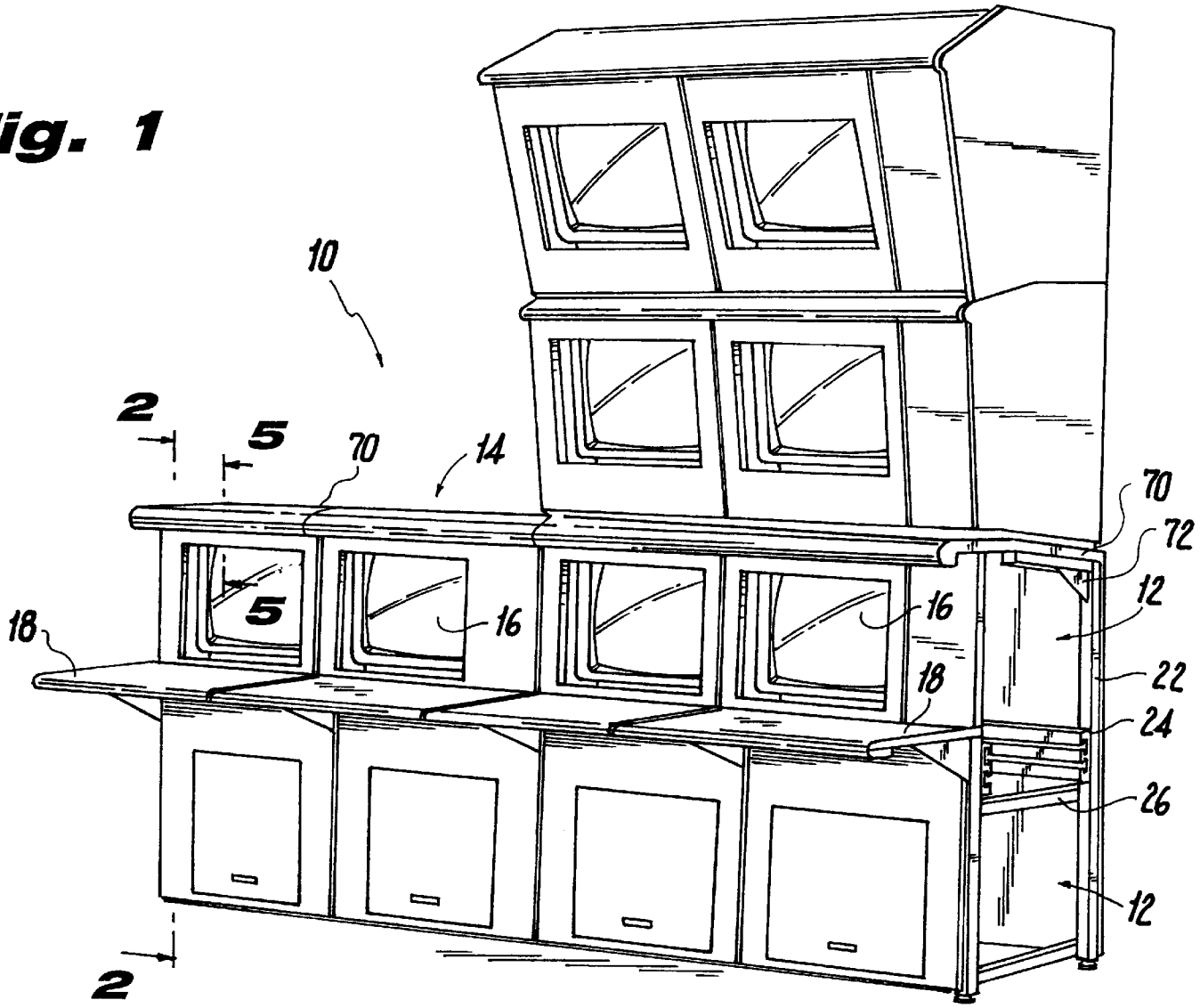
FIG. 1 is a perspective view of a multiconsole arrangement constructed in accord with the present invention.

As seen in FIG. 1, the present invention is adapted to provide console modules as part of a multi-unit system such as used in telecommunications monitoring installations, multifacility control systems, and the like. In such installations a number of terminals, each having a keyboard and monitor, are networked into remote large mainframe computers (not shown). Sometimes each terminal may be provided with two or more monitors, stacked one on another, to provided the operator with multiple views.

Figure 2:
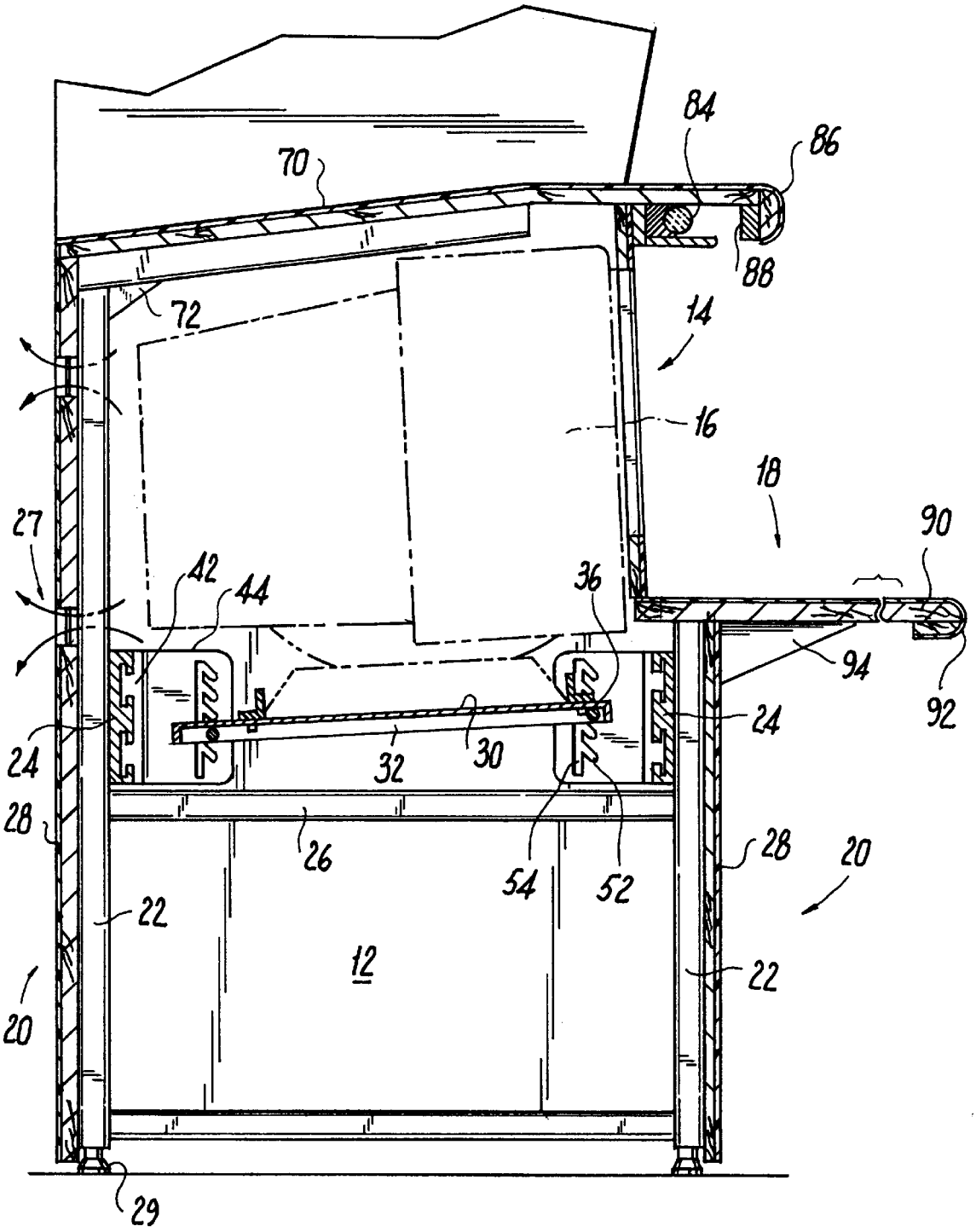
FIG. 2 is a partially sectioned view of the console framework showing schematically the construction thereof.

As seen in FIGS. 1 and 2, the console comprises one or more unitary enclosures generally depicted by the numeral 10, defining a hollow base 12 over which is formed an open-front canopy 14 in which it is housed a monitor 16 (CRT) or other electronic component. Adjustably mounted to the base 12 in front of the canopy 14, is a table 18 on which for example, a keyboard may be placed.

As seen in FIG. 2, the enclosure 10 formed of front and rear wall members 20, each comprise a pair of tubular corner posts 22 interconnected by one or more horizontal braces 24, which, as will be seen herein after also serve as hangers for the monitor support. Depending upon the height and width of the front and rear walls, one or two braces will be sufficient. The front and rear wall members 20 are also interconnected by side braces 26. Each of the braces 24 and side braces 26 are formed of U-shaped channel members, which inherently have sufficient strength to maintain the wall rigid.

The individual channel members also have the ability to hide the required fasteners such as set screws or the like fastening the braces to the posts. The U-shaped channels are preferably provided with a series of spaced or arrayed holes for allowing quick connection of the fasteners with a minimum of tools. The wall members 20 are completed by covering them with panel facia 28 which are decoratively finished for both aesthetic and wear characteristic. The rear panels may be provided with air holes or louvers 27 for the ventilation of the enclosed equipment.

The panels are preferably attached by set screws or the like to the posts and braces from the interior of the enclosure to avoid their interference with the operator. To this end, blind bore are formed in a uniform spacing along the marginal edge of each panel. In this manner, a rectangular enclosure of any selected size can be formed by simply employing at least two panels, arranged parallel to each other to define front and rear walls. The missing side walls may be formed by sheathing them with decorative panels secured to the associated corner posts of the front and rear walls. The vertical corner posts are leveled by any conventional adjustable foot 29. Such leveling feet are widely commercially available.

It is to be appreciated that in arranging a series of contiguous consoles, that is one abutting an other, that space and materials can be conserved by utilizing the corner posts and enlarged horizontal braces for adjacent consoles and providing panel facia adapted to extend over more than one enclosure. Further, in providing for abutting consoles, the side walls of the enclosure can be omitted since the interior of the enclosures will be hidden from view by the adjacent console. The end consoles in any arrangement will be provided with a panel facia unless, of course, they are, in fact, set abutting to a building wall.

Clearly, the enclosures, thus constructed, are modular units being capable of being built in a variety of sizes to fit most any site. On the other hand, the construction can be customized to conform to the specific and often unique requirements of the user. Cutting of the post and brace length and modifying angling of adjacent consoles can be made without the use of expensive tools.

The enclosure, thus described, lends itself to the application of certain improvements, provided by the present invention. A significant improvement is obtained by providing a novel monitor supporting table which is adjustable both in height and in tilt.

Figure 3:
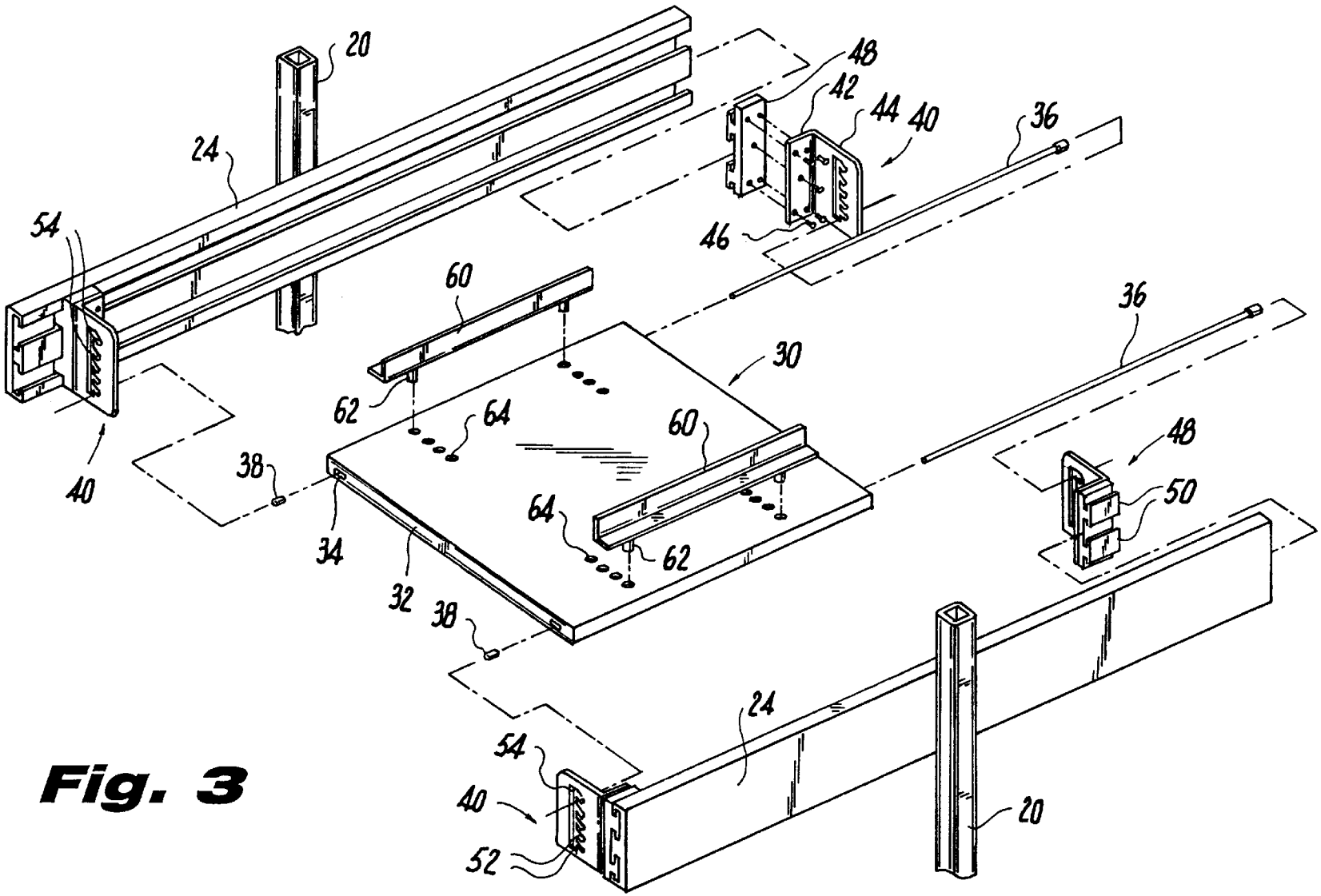
FIG. 3 is an exploded and expanded view of the monitor shelf and adjustable bracket assembly.

The monitor support, as seen in detail in FIG. 3, comprises a generally rectangular shelf 30. The shelf may be a solid block, or a thin sheet provided with integral skirts along its edges 32 so as to be stable, non-twistable and non-flexible. The shelf 30 is provided with a through hole 34, inward of its front and rear edges running parallel to the front and rear edges from side to side. An elongated rod 36 is inserted within each hole 34 so that one rod will be parallel to the front structural wall, while the other rod is parallel to the rear wall. Each end of each rod 36 is covered by a push nut 38 to prevent the rod from falling out. Each rod 36 itself is somewhat longer than the width of the shelf 30 so that at each end, a stub portion extends away from the side edge of the shelf 30.

The supporting shelf is adjustably mounted on four bracket assemblies 40 secured to the posts 20 of the front and rear frame walls of the enclosures 10. Each bracket assembly 40 comprises an L-shaped plate comprising short leg 42 and a long leg 44 perpendicular to each other; both oriented in a vertical direction. The short leg 42 is secured by a plurality of set screws 46 to a backing 48, the rear side of which is formed with at least two horizontally T-shaped square undercut male slide members 50 defining one half of a mating dovetail slide. The larger plate 44 is provided with a plurality of downwardly inclined cut-outs in the form a parallel fingers 52 joined at their base by a common vertical interconnecting slot 54.

The bracket assemblies 40 are secured in pairs on horizontally extending hangers 56 extending the entire width of the front and rear frame wall members 20 respectively. The hangers 56 are fixedly secured by set screws from the rear of the tubular corner posts 22, and are each provided on their face with continuous female slide grooves 58 defining the second half of the mating dovetail slide.

In assembling the console, the front and rear pairs of the bracket assemblies 40 are slidably dovetailed into the hangers 24 and adjustable positioned in the lateral direction centered in the open front console canopy 14 with the rear pair of brackets assemblies 40 aligned respectively directly behind with the front pair. The fingers 52 in each bracket being oriented in the same direction, preferably toward the front of the enclosure.

The brackets 40, thus, extend fixedly in a stable position inwardly of the console enclosure. The monitor supporting shelf 30 is then placed between the brackets assemblies 40 and the stub ends of the rods 36 protruding from each side of the shelf inserted in and passing through one of the associated fingers 52 of the bracket and held in place by the push nuts 38. Because of the weight of the supporting shelf 30 and the monitor 16 when placed on it, the shelf has a downward thrust which causes the stub ends of the rods 36 to seat within one of the selected fingers 52, locking the shelf in place. By shifting the shelf forwardly and/or rearwardly, the shelf 30 is loosened and the rods 36 may be placed via the common interconnecting slot 54 in another selected finger, thus moving the shelf 30 up or down into another level or tilt.

With the foregoing arrangement, the monitor supporting shelf may be raised and lowered and/or tilted fore and aft as desired to position the monitor at a desired height and angle. The front and rear edges of the shelf can be manipulated independently of each other so that the shelf can be tilted at both, the front and rear end. Raising and lowering of the shelf is independent of the tilt, as is the tilting of the shelf.

One or more safety bars 60 may be secured to the surface of the shelf 30 to prevent the monitor from sliding on the tilted shelf. To this end, the safety bar 60 is provided with protruding pegs 62 on its lower edge which will force fit into corresponding spaced holes 64 in the surface of the shelf 30. The shelf is preferably provided with a plurality of spaced holes 64 so that the safety bar 60 may be most conveniently placed to fit the size of the monitor base and the selected tilt of the shelf.

The canopy 14 of the enclosure 10 is formed of a sheet-like roof 70, secured by a pair of triangular side gussets 72, which are attached at their rear to the corner posts 22 of the rear wall. When stacked installations are made, the gussets 72 and roof 70 may be reinforced to have the necessary strength to carry the upper load. The roof 70 may even be removed and replaced with a supporting floor. The roof 70 may be tilted upwardly in single stack arrangement and flat or even downwardly tilted when an upper stack is used.

At the front end of the canopy roof 70, is a lamp 84, preferably contained in its own U-shaped housing 86 so as to illuminate the keyboard table 18. On the other hand, the canopy 70 may be formed with a U-bend, at its front end, into which the lamp 84 may be secured. In either case, a suitable heat shield and reflector lining 88 within the housing is provided.

Figure 4:
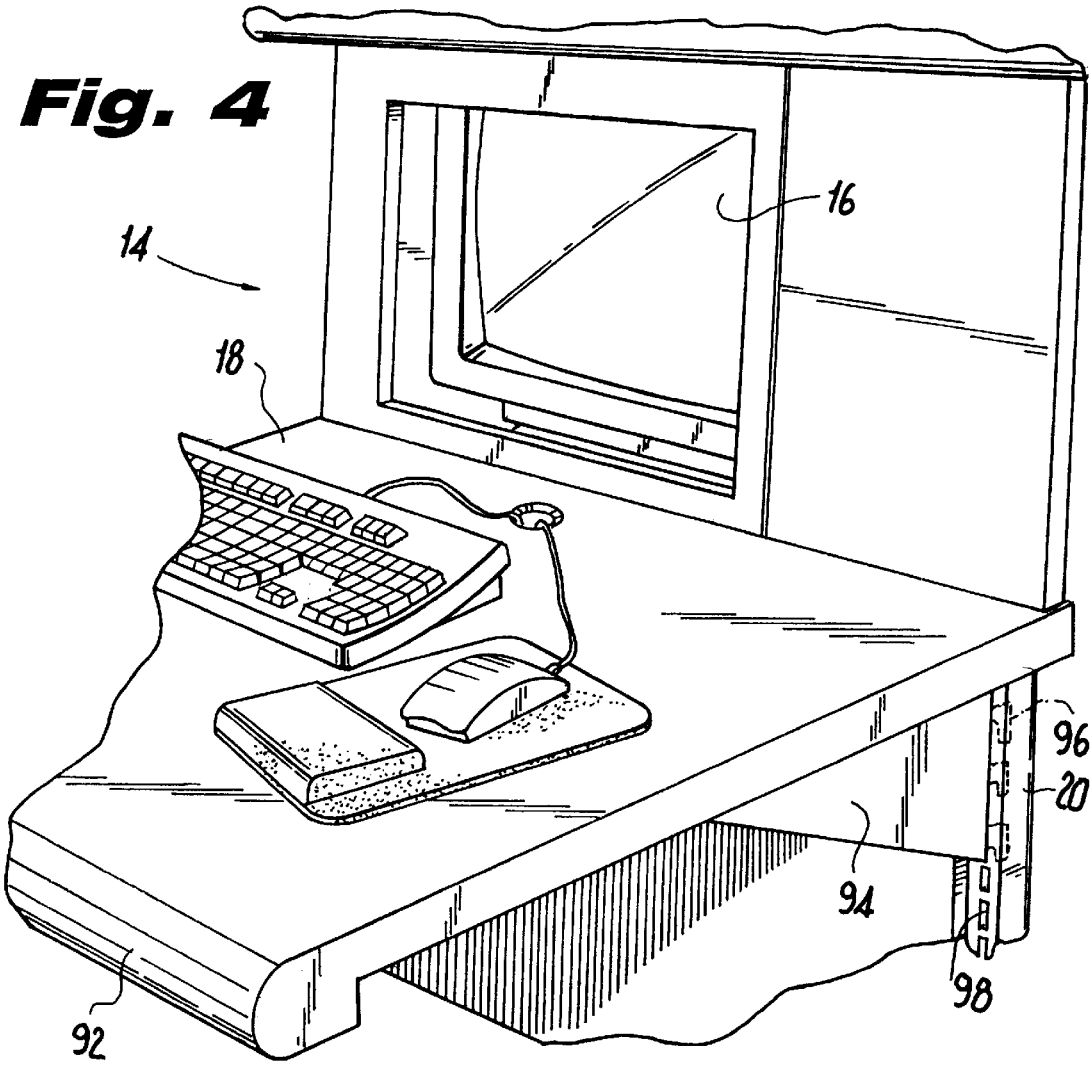
FIG. 4 is an exploded and expanded view of the keyboard table and it's adjustable bracket assembly.
Figure 5:
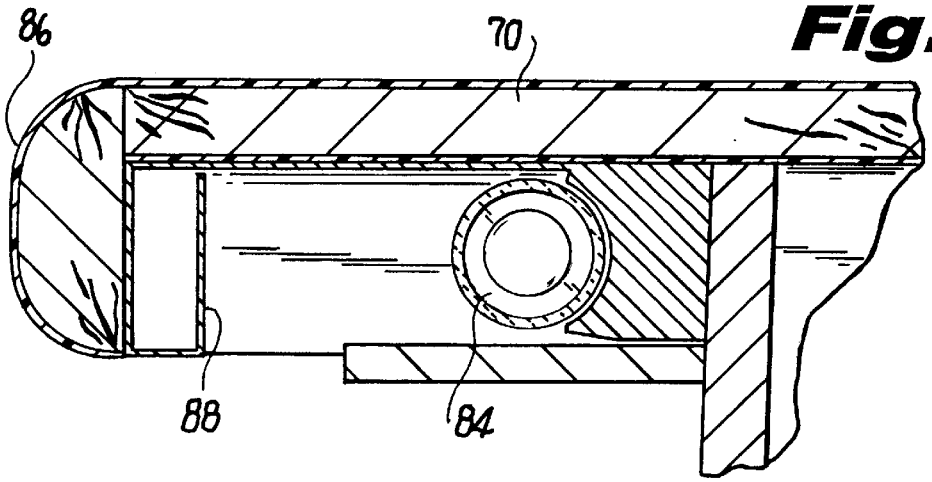
FIG. 5 is an enlarged view of the upper canopy and lamp.

The keyboard table 18, as seen in detail in FIG. 4, is formed of a block or stamped sheet 90 having bullnose edges 92 for safety as well as decoration. Preferably, the keyboard table 18 is secured at its side to gussets 94, which are themselves adjustably attached to the tubular posts 22 of the front wall. The keyboard table 18 may include roller track slide supports which permit the table to be pulled out as needed and pushed in when not in use.

The gussets 72 and the gussets 94 may be integrally fabricated with their respective canopy 70 and keyboard table 18 for added strength or they may be removably attached for convenience. Each of the vertical edges of both sets of gussets may be provided with spaced keys 96 (FIG. 4), while the associated corner posts are provided with spaced slots 98 into which the keys 96 cooperatively engage. In this manner, the canopy roof 70 and keyboard table 18 may be removably and adjustably attached to the enclosure. This is particularly advantageous, with regard to the keyboard table 18, since its height may thus be easily adjusted for the individual user. Similar height adjustment can be made for the canopy to accommodate enlarged monitors. The canopy may also be easily removable to be replaced with a flat structure, of similar design, to support a second level monitor.

It will be understood that the enclosure components may be made of aluminum, steel, wood, plastics or any combination thereof as is customary and usual in the act. Preferably the corner posts are steel for added strength, while the panels may be plastic, wood or aluminum as desired. If a metal is used, the metal may be coated with a plastic or wood laminate for decoration or noise reduction.

Various modifications and changes have been disclosed herein and others will be obvious to those skilled in the present art. It is, therefore, to be understood that the disclosure is illustrated only, and not limiting of the invention.

What is claimed is:

1. In an electronic work station having at least a keyboard and a monitor, a modular console comprising a front and rear structural walls interconnected by side supports, a table extending forwardly from said front wall on which the keyboard rests, a canopy a portion of which abuts and extends upwardly from said table and has an opening displaying said monitor in a forward direction, and a shelf located between said front and rear structural walls supporting the monitor, means for adjustable supporting said shelf on the walls comprising an elongate guide rail fixed in a horizontal side to side position on each of said front and rear walls, and two pair of brackets supporting said shelf, each pair mounted on respective ones of said rails and extending perpendicularly to said front and rear walls, each pair of brackets slideably movable along the length of respective ones of said rails allowing lateral adjustment of said shelf along the length of said front and rear structural walls, said brackets each including a vertical slot with notches along a vertical direction of the slots for vertical adjustment of the shelf.

2. The modular console according to claim 1, wherein each of said elongate guide rails include a plurality grooves along the length thereof and each of said brackets comprises a plate having a long leg and a short leg, said short leg secured to a backing having at least two male slide members for insertion into said grooves.

3. The modular console according to claim 2, wherein the long leg of each of said plates has said slot, said notches comprising a plurality of parallel slots interconnected by said vertical slot, said shelf having rod stubs extending laterally from the sides thereof in paired axial alignment, said rod stubs being inserted within a selected one of said plurality of parallel slots in a respective one of said plates to hold said shelf, said shelf movable to shift said front and rear paired rod stubs independently of each other to adjust said shelf up and/or down and to adjust the tilt of said shelf.

4. The modular console according to claim 3, wherein the plurality of parallel slots in each of said plates are inclined downwardly.

5. The modular console according to claim 1, wherein said canopy is an integral canopy having an open front enclosing said monitor.

6. The modular console according to claim 5, including a lamp mounted to said canopy to illuminate the keyboard table.

7. The modular console according to claim 1, wherein said console front and rear walls are formed of a pair of tubular corner posts interconnected laterally and transversely by at least one horizontal brace along each side and covered at least in part by panel facia.

* * * * *

UNITED STATES PATENT AND TRADEMARK OFFICE

CERTIFICATE OF CORRECTION

PATENT NO. : 5,954,408

DATED : September 21, 1999

INVENTOR(S) : Peter Bogucki

It is certified that error appears in the above–identified patent and that said Letters Patent are hereby corrected as shown below:

Column 5, line 21, change "adjustable" to --adjustably--.

Signed and Sealed this

Ninth Day of May, 2000

*Attest:*

Q. TODD DICKINSON

*Attesting Officer*

*Director of Patents and Trademarks*